US005133318A

United States Patent [19]

Yokotani et al.

[11] Patent Number: 5,133,318

[45] Date of Patent: Jul. 28, 1992

[54] AFTER-BURNING PREVENTIVE IGNITION APPARATUS FOR AN INTERNAL COMBUSTION ENGINE

[75] Inventors: Masahiro Yokotani; Mitsuru Koiwa, both of Himeji, Japan

[73] Assignee: Mitsubishi Denki Kabushiki Kaisha, Tokyo, Japan

[21] Appl. No.: 700,982

[22] Filed: May 16, 1991

[30] Foreign Application Priority Data

May 18, 1990 [JP] Japan ..... 2-126983

[51] Int. Cl.[5] ..... F02P 9/00

[52] U.S. Cl. ..... 123/335

[58] Field of Search ..... 123/335, 334

[56] References Cited

U.S. PATENT DOCUMENTS 3,572,302 3/1971 Wollesen ..... 123/335

3,738,340 6/1973 Olson ..... 123/335

3,762,383 10/1973 Richards et al. ..... 123/335

3,789,810 2/1974 Sattler ..... 123/335

FOREIGN PATENT DOCUMENTS 58-133475 8/1983 Japan .

*Primary Examiner*—Andrew M. Dolinar

*Attorney, Agent, or Firm*—Sughrue, Mion, Zinn, Macpeak and Seas

[57] ABSTRACT

A governor apparatus for an internal combustion engine of a capacitor discharge type capable of effectively preventing after-burning due to excessive fuel supply and building abnormal combustion, etc., during the high-speed operation of the engine. To this end, ignition is intermittently performed or periodically stopped and performed when the number of revolutions per minute of the engine is greater than a predetermined value.

5 Claims, 4 Drawing Sheets

AFTER-BURNING PREVENTIVE IGNITION APPARATUS FOR AN INTERNAL COMBUSTION ENGINE

BACKGROUND OF THE INVENTION

The present invention relates to an ignition apparatus for an internal combustion engine that prevents after burning.

A typical example of a known ignition apparatus for preventing after burning is illustrated in FIG. 3. The apparatus includes a signal generator 1 for generating a signal in synchronism with the rotation of an internal combustion engine, a waveform shaper 2 connected to the signal generator 1 for shaping the waveform of the output signal of the signal generator 1 into an appropriate form, a frequency to voltage (F/V) converter 3 connected to the waveform shaper 2 for converting the frequency of the thus shaped output signal of the signal generator 1 into a corresponding voltage, a reference voltage source 4 generating a reference voltage Vr corresponding to a predetermined number of revolutions per minute of the engine, a comparator 5 having a first positive or non-inverted input terminal connected to the F/V converter 3, a second negative or inverted input terminal connected to the reference voltage source 4 and an output terminal, and a synchronizer 6 connected to the waveform shaper 2 and the output terminal of the comparator 3. The synchronizer 6 comprises an AND gate 6*a* which has a first input terminal connected to the output terminal of the comparator 5 and a second input terminal connected through an inverter 6*b* to the waveform shaper 2, an AND gate 6*c* which has a first input terminal connected to a node between the inverter 6*b* and the second input terminal of the AND gate 6*a* and a second input terminal connected through an inverter 6*d* to a node between the output terminal of the comparator 5 and the first input terminal of the AND gate 6*a*, and a flip-flop circuit 6*e* having a set terminal connected to the output terminal of the first AND gate 6*a* and a reset terminal connected to the output terminal of the second AND gate 6*c*.

The apparatus further includes an AND gate 7 having a first input terminal connected to the waveform shaper 2, a second input terminal connected to the flip-flop circuit 6*e* of the synchronizer 6 and an output terminal, a driver 8 connected to the output terminal of the AND gate 7, a switch 9 in the form of a power transistor circuit connected to the driver 8, and an ignition coil comprising a primary winding and a secondary winding having their one end connected in common to a power source 11, the primary winding having the other end thereof connected to the power transistor circuit 9, and the secondary winding having the other end thereof connected to an unillustrated spark plug.

The operation of the known ignition apparatus as constructed above will now be described in detail with particular reference to waveform diagrams of FIGS. 4(*a*) and through 4(*f*).

First, the signal generator 1 generates an ignition signal A in synchronism with the rotation of the engine which has a waveform as shown in FIG. 4(*a*). The ignition signal A is input to the waveform shaper 2 which shapes the signal A to provide a shaped signal B having square pulses, as shown in FIG. 4(*b*). A part of the shaped signal B of the waveform shaper 2 is then fed to the F/V converter 3 where the frequency of the signal B is converted into a corresponding voltage C, as shown in FIG. 4(*c*), which in turn is supplied to the first input terminal of the comparator 5. The comparator 5 compares the output voltage C from the F/V converter 3 with the reference voltage Vr fed to the second input terminal thereof, and generates an output signal of a high level, as shown in FIG. 4(*d*), when the voltage C is greater than the reference voltage Vr.

The output signal D from the comparator 5 is input to the first input terminal of the AND gate 6*a* and at the same time to the second input terminal of the AND gate 6*c* through the inverter 6*d*. Based on the output signal B from the waveform shaper 2 and the output voltage D from the comparator 5, the synchronizer 6 generates a mask signal E, which has a waveform as shown in FIG. 4(*e*).

The mask signal E thus generated is fed to the second input terminal of the AND gate 7 to the first input terminal of which the output signal B from the waveform shaper 2 is input. When the signals B, E are both high, the AND gate 7 generates an output signal F in the form of an ignition control signal, as shown in FIG. 4(*f*), which is fed through the driver 8 to the power transistor circuit 9, making it conductive. With the conduction of the power transistor circuit 9, a current flows from the power source 11 into ground through the primary winding of the ignition coil 10 and the now conductive power transistor circuit 9, so that a high voltage is developed in the secondary winding, causing an unillustrated spark plug to generate a spark. Thus, as can be seen from FIGS. 4(*c*) and 4(*f*), when the number of revolutions per minute of the engine exceeds a predetermined value corresponding to the output voltage Vr of the reference voltage source 4, the known apparatus stops ignition, suppressing a further increase in the rotational speed of the engine.

The above-described known ignition apparatus, however, has the following problem. When the number of revolutions per minute of the engine, having once increased above the predetermined value, decreases again below the predetermined value due to continued non-ignition or misfiring of the spark plug for a prescribed period of time, ignition is restarted but at this time, after-burning phenomena will often take place due to resultant excessive fuel supply, abnormal combustion and the like.

SUMMARY OF THE INVENTION

Accordingly, the present invention is intended to obviate the above-mentioned problem encountered with the known ignition apparatus.

An object of the present invention is to provide a novel and improved ignition apparatus for an internal combustion engine of the type described which can prevent such after-burning phenomena in an effective manner during high-speed operation of the engine.

In order achieve the above object, according to one aspect of the present invention, there is provided an ignition apparatus for an internal combustion engine comprising:

first means for performing normal ignition in synchronism with the rotation of the engine; and second means for intermittently performing ignition when the number of revolutions per minute of the engine is greater than a predetermined value.

Preferably, the second means periodically stops and performs ignition when the number of revolutions per minute of the engine is greater than the predetermined value.

According to another aspect of the invention, there is provided an ignition apparatus for an internal combustion engine comprising:

a signal generator for generating a signal having a frequency representative of the number of revolutions per minute of the engine in synchronism with the rotation thereof;

a waveform shaper for shaping the waveform of the output signal of the signal generator;

a frequency to voltage converter for converting the frequency of the output signal of the signal generator into a corresponding voltage;

a comparator for comparing the output voltage of the converter with a predetermined reference voltage which corresponds to a predetermined number of revolutions per minute of the engine and for generating an output signal when the former is greater than the latter;

pulse generating means for generating a pulse signal containing pulses at predetermined intervals; and synchronized ignition driving means for driving an ignition coil based on the output signals of the waveform shaper, the comparator and the pulse generating means so as to perform normal engine operation when there is no output signal generated by the comparator, the synchronized ignition driving means being further operable to intermittently drive the ignition coil when the comparator generates an output signal.

Preferably, the synchronized ignition driving means periodically drives the ignition coil when the comparator generates an output signal.

In one embodiment, the synchronized ignition driving means comprises:

a first AND gate having a first input terminal connected to receive the output signal of the comparator, a second input terminal connected to receive the output signal of the pulse generating means, and an output terminal;

a synchronizer connected to the output terminal of the first AND gate and the waveform shaper for generating an output signal based on the output signals of the first AND gate and the waveform shaper; and a second ANd gate having a first input terminal connected to the waveform shaper, a second input terminal connected to the synchronizer, and an output terminal connected to a switch for controlling the ignition coil, the second AND gate being operable to generate, based on the output signals of the waveform shaper and the synchronizer, an ignition signal for turning on and off the switch.

The above and other objects, features and advantages of the present invention will more readily apparent from the following detailed description of a preferred embodiment of the invention taken in conjunction with the accompanying drawings.

DESCRIPTION OF A PREFERRED EMBODIMENT

A preferred embodiment of the present invention will now be described in detail while referring to the accompanying drawings.

Figure 1:
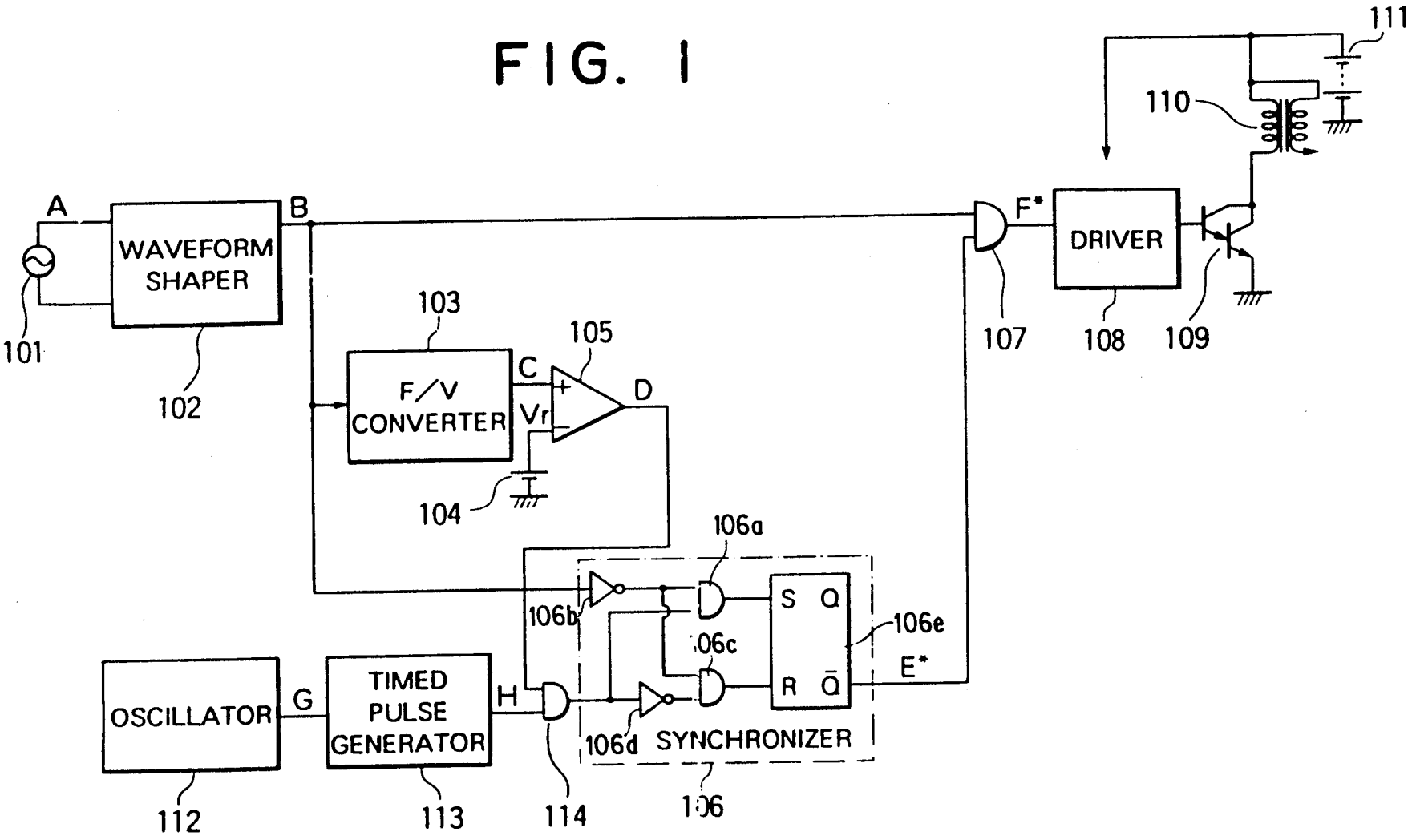
FIG. 1 is a block diagram showing the general arrangement of an ignition apparatus for an internal combustion engine in accordance with the present invention.

In FIG. 1, there is illustrated an ignition apparatus for an internal combustion engine constructed in accordance with the principles of the present invention. The apparatus illustrated includes a signal generator 101, a waveform shaper 102, a F/V converter 103, a reference voltage source 104, a comparator 105, a synchronizer 106, an AND gate 107, a driver 108, a switch 109 in the form of a power transistor circuit, an ignition coil 110 and a power source 111, all of which are the same as the corresponding elements 1 through 11 of the known apparatus of FIG. 3. The synchronizer 106 is substantially the same as the one 6 of FIG. 3, and comprises a pair of AND gates 106*a*, 106*c*, a pair of inverters 106*b*, 106*d*, and a flip-flop circuit 106*e*. In addition to these elements, the apparatus of the invention further includes an oscillator 112 for generating a signal G of a predetermined frequency, a timed pulse generator 113 connected to the oscillator 112 for generating pulses each having a predetermined pulse width based on the output signal G of the oscillator 112, and an AND gate 114 having a first input terminal connected to the output terminal of the comparator 105, a second input terminal connected to the timed pulse generator 113, and an output terminal connected to the synchronizer 106, i.e. to the second input terminal of the AND gate 106*a* and to the second input terminal of the AND gate 106*c* through the inverter 106*d*. Thus, in the present invention, the output terminal of the comparator 105 is not directly connected to the synchronizer 106, as in the case of the known apparatus of FIG. 3, but it is instead connected to the first input terminal of the AND gate 114. According to this embodiment, the oscillator 112 and the timed pulse generator 113 constitute a pulse signal generator. Also, the AND gate 114, the synchronizer 106, the AND gate 107, the driver 108 and the power transistor circuit 109 together constitute a synchronized ignition driving means.

Next, the operation of the above embodiment will be described in detail with particular reference to FIGS. 2(*a*) through 2(*h*).

Figure 3:
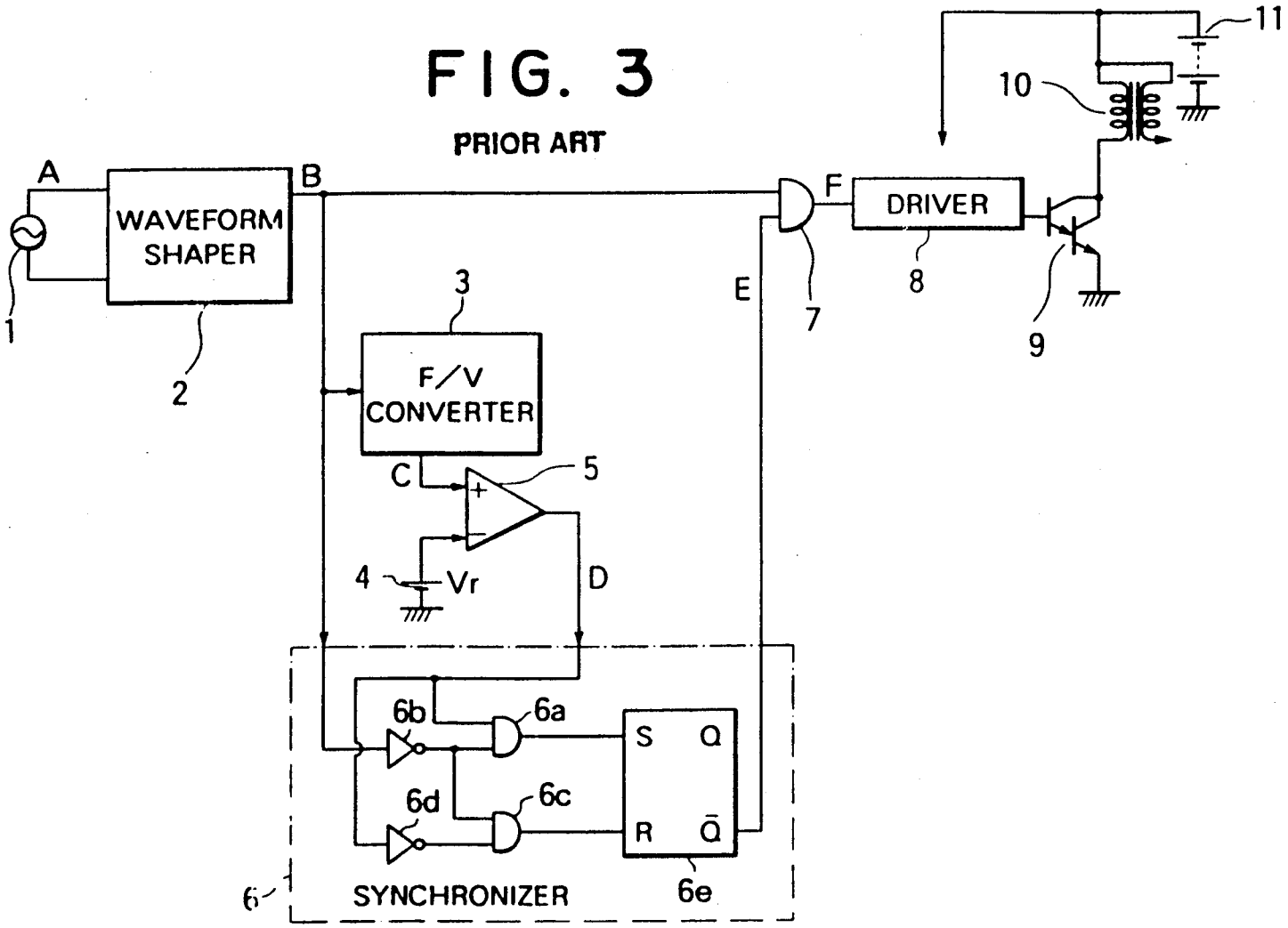
FIG. 3 PRIOR ART
FIG. 3 is a block diagram showing the general arrangement of a known ignition apparatus for an internal combustion engine.
Figures 4A, 4B, 4C, 4D, 4E, 4F:
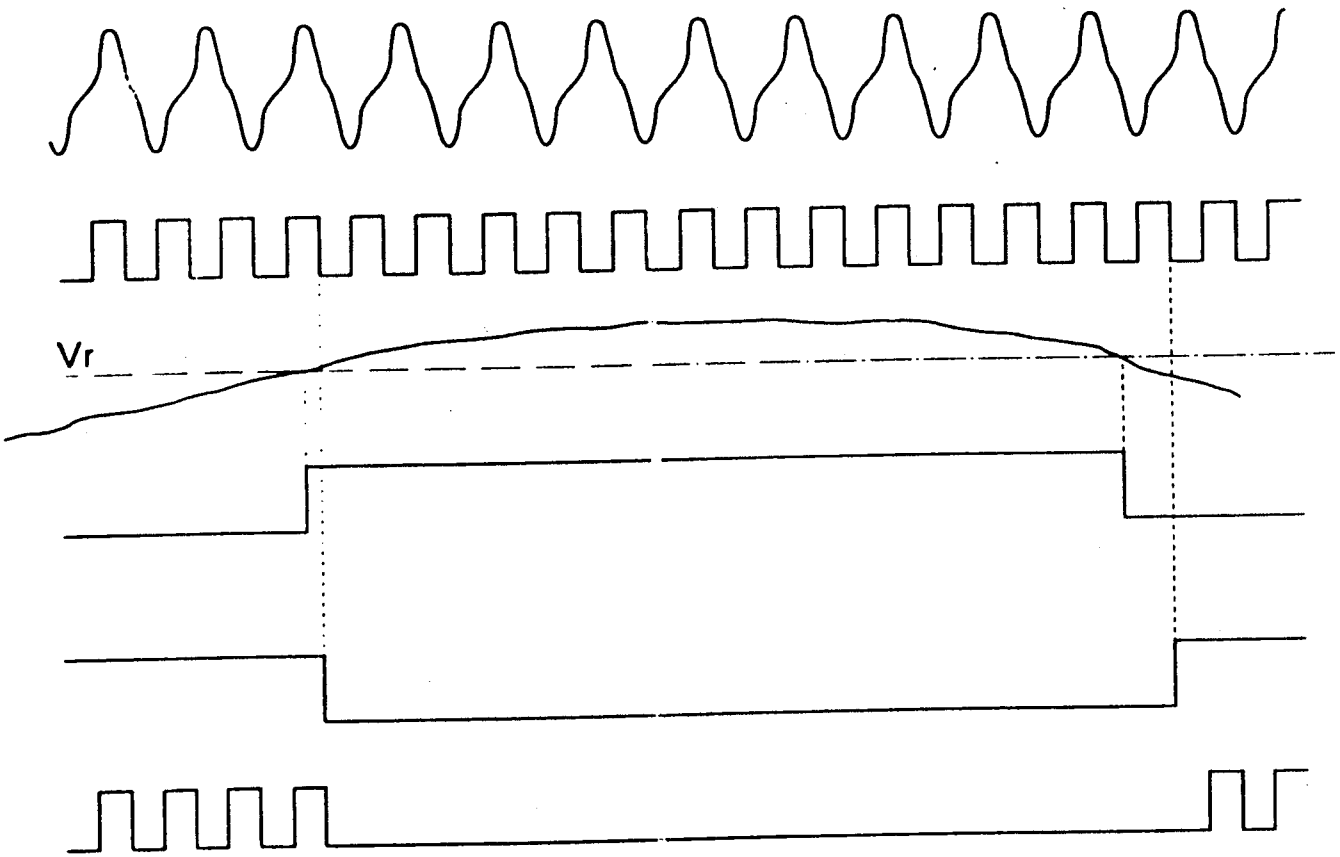
FIG. 4(a) PRIOR ART
FIG. 4(b) PRIOR ART
FIG. 4(c) PRIOR ART
FIG. 4(d) PRIOR ART
FIG. 4(e) PRIOR ART
FIG. 4(f) PRIOR ART
FIGS. 4(*a*) through 4(*f*) are waveform diagrams showing the waveforms of output signals of various elements of the known apparatus of FIG. 3.

First, the waveform shaper 102, the F/D converter 103 and the comparator 105 operate in the same manner as the corresponding elements 2, 3 and 5 of FIG. 3, and hence a detailed description thereof is omitted.

Figures 2A, 2B, 2C, 2D, 2E, 2F, 2G, 2H:
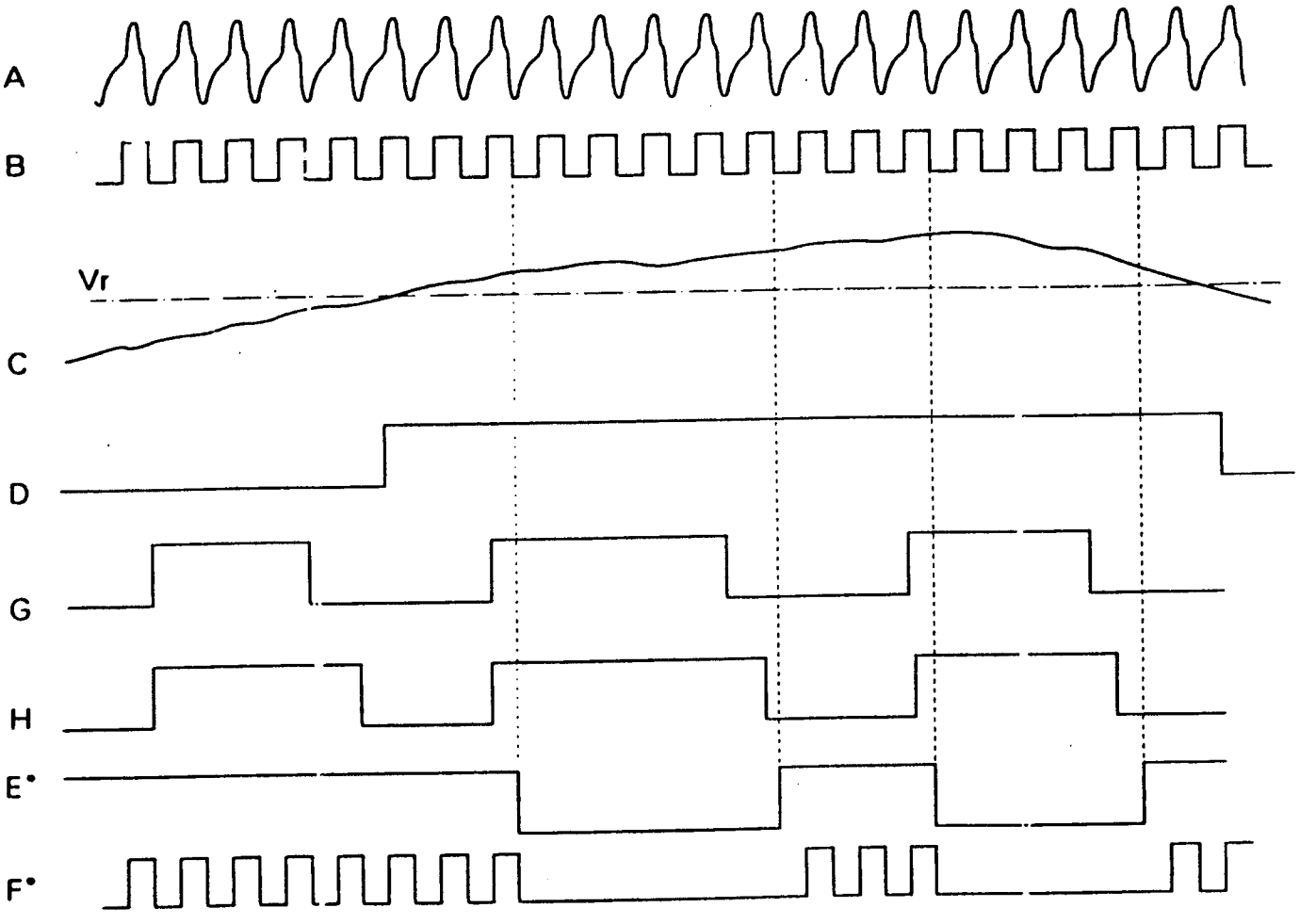
FIGS. 2(*a*) through 2(*h*) are waveform diagrams showing the waveforms of output signals of various elements of the apparatus of FIG. 1.

The oscillator 112 generates a pulse signal G containing square pulses which repeatedly occur with a predetermined period, as shown in FIG. 2(*e*). Based on the pulse signal G, the pulse generator 113 generates a pulse signal H containing square pulses each having a pulse width corresponding to a predetermined time span such as a misfiring or non-ignitioin time at a predetermined time interval corresponding to the predetermined period of the pulse signal G, as shown in FIG. 2(*f*). In FIG. 2(*f*), the no-pulse period containing no pulse corresponds to a predetermined ignition period for which a current is supplied to the primary winding of the ignition coil 110. The pulse signal H thus generated is fed to the second input terminal of the AND gate 114, to the first input terminal of which the output signal or voltage D is supplied.

When the signals D and H are both high, the AND gate 114 generates an output signal which is fed to the synchronizer 106, i.e., to the second input terminal of the AND gate 106*a* and to the second input terminal of the AND gate 106*c* through the inverter 106*d*. Based on the output signal B from the waveform shaper 102 and the output signal of the AND gate 114, the synchronizer 106 generates from the flip-flip circuit 106*e* a mask signal E* having a waveform, as shown in FIG. 2(*g*), which is then supplied to the second input terminal of the AND gate 107, to the first input terminal of which the output signal B from the waveform shaper 102 is applied.

Based on the signals B and E*, the AND gate 107 generates an ignition signal F* which has a wave form as shown in FIG. 2(*h*). That is, the AND gate 107 generates a square pulse when the signals B and E* are both high. In other words, during the time when the number of revolutions per minute of the engine is greater than a predetermined value corresponding to the reference voltage Vr, square pulses are intermittently or periodically generated by the AND gate 107, as clearly seen from FIG. 2(*h*). The output signal F* from the AND gate 107 is supplied to the driver 108 so that the power transistor circuit 109 is turned on and off by the driver 108 on the basis of the signal F*, causing an illustrated spark plug connected to the secondary winding of the ignition coil 110 to generate a spark.

In this manner, according to the present invention, when the number of revolutions per minute of the engine exceeds the predetermined value, ignition is intermittently performed. That is, ignition is initially stopped and then it is periodically performed and stopped so that an increase in the rotational speed of the engine is effectively suppressed while preventing after burning as well. This also serves to prevent excessive fuel supply and abnormal combustion. In this connection, it is preferable that the ratio of firings or ignitions to misfirings or non-ignitions during such a periodic ignition period be set to 3:7.

What is claimed is:

1. An ignition apparatus for an internal combustion engine comprising:

a signal generator for generating a signal having a frequency representative of the number of revolutions per minute of the engine in synchronism with the rotation thereof;

a waveform shaper for shaping the waveform of the output signal of said signal generator;

a frequency to voltage converter for converting the frequency of the output signal of said signal generator into a corresponding voltage;

a comparator for comparing the output voltage of said converter with a predetermined reference voltage which corresponds to a predetermined number of revolutions per minute of the engine and for generating an output signal when the former is greater than the latter;

pulse generating means for generating a pulse signal containing pulses at predetermined intervals; and synchronized ignition driving means for driving an ignition coil based on the output signals of said waveform shaper, said comparator and said pulse generating means so as to perform normal engine operation when there is no output signal generated by said comparator, said synchronized ignition driving means being further operable to intermittently drive the ignition coil when said comparator generates an output signal.

2. An ignition apparatus according to claim 1, wherein said synchronized ignition driving means periodically drives the ignition coil when said comparator generates an output signal.

3. An ignition apparatus according to claim 1, wherein said synchronized ignition driving means comprises:

a first AND gate having a first input terminal connected to receive the output signal of said comparator, a second input terminal connected to receive the output signal of said pulse generating means, and an output terminal;

a synchronizer connected to the output terminal of said first AND gate and said waveform shaper for generating an output signal based on the output signals of said first AND gate and said waveform shaper; and a second AND gate having a first input terminal connected to said waveform shaper, a second input terminal connected to said synchronizer, and an output terminal connected to a switch for controlling the ignition coil, said second AND gate being operable to generate, based on the output signals of said waveform shaper and said synchronizer, an ignition signal for turning on and off the switch.

4. An ignition apparatus according to claim 3, wherein said pulse generating means comprises:

an oscillator for generating a pulse signal containing pulses at predetermined intervals; and a timed pulse generator for periodically generating, based on the output signal of said oscillator, a pulse having a predetermined pulse width which is fed to the second input terminal of said first AND gate.

5. An ignition apparatus according to claim 3, wherein said synchronizer comprises:

a third AND gate having a first input terminal connected to said waveform shaper through an inverter, a second input terminal connected to the output terminal of said first AND gate, and an output terminal;

a fourth AND gate having a first input terminal connected to said waveform shaper through the inverter, a second input terminal connected to the output terminal of said first AND gate through an inverter, and an output terminal; and a flip-flop circuit having a set terminal connected to the output terminal of said third AND gate, a reset terminal connected to the output terminal of said fourth AND gate, and an output terminal connected to the second input terminal of said second AND gate.

* * * * *